US005380172A

United States Patent [19]

Ulbing

[11] Patent Number: 5,380,172

[45] Date of Patent: Jan. 10, 1995

[54] PERISTALTIC ACTION PRECISION PUMP FILLER

[76] Inventor: Otmar Ulbing, 212 East St., Pittsford, N.Y. 14534

[21] Appl. No.: 174,743

[22] Filed: Dec. 29, 1993

[51] Int. Cl.[6] ..... F04B 43/08

[52] U.S. Cl. ..... 417/476; 417/360; 452/40

[58] Field of Search ..... 417/474, 476, 477 R, 417/477 B, 477 F, 477 G, 477 H, 477 K, 412, 360, 361; 452/40, 29, 37

[56] References Cited

U.S. PATENT DOCUMENTS

| | | | |
|---|---|---|---|
| 3,582,234 | 6/1971 | Israeli | 417/477 R |
| 3,712,762 | 1/1973 | Kenney | 417/477 |
| 4,021,885 | 5/1977 | Muller | 452/40 |
| 4,302,164 | 11/1981 | Manella | 417/474 |
| 4,515,589 | 5/1985 | Austin et al. | 604/122 |
| 4,529,106 | 7/1985 | Broadfoot et al. | 222/207 |
| 4,735,553 | 4/1988 | Vidal | 417/33 |
| 4,735,557 | 4/1988 | Neumuller | 417/477 R |
| 4,746,279 | 5/1988 | Manella | 417/474 |
| 4,767,289 | 8/1988 | Parrott et al. | 417/477 |
| 5,056,293 | 10/1991 | Richards et al. | 452/29 |
| 5,096,393 | 3/1992 | Van Steenderen | 417/477 |
| 5,102,015 | 4/1992 | Barnard et al. | 222/135 |

FOREIGN PATENT DOCUMENTS

| | | | |
|---|---|---|---|
| 0200026 | 1/1986 | European Pat. Off. | 417/477 |
| 1013172 | 12/1952 | Germany | 417/477 |

OTHER PUBLICATIONS

Pumps in Meat and Poultry Processing, Processing, Feb. 1991, pp. 45 & 46.

Pumps for Gentle Handling, Dairy Industries International 52(7) 33,35,37, 1987.

Pumps for Hygiene Applications, Dairy Industries International 54(5) 36+.

*Primary Examiner*—Richard A. Bertsch
*Assistant Examiner*—Peter Korytnyk
*Attorney, Agent, or Firm*—M. Lukacher

[57] ABSTRACT

A peristaltic action pump filler includes a frame for supporting an elongate fill tube. A carriage member is mounted to the frame for reciprocating translation therealong. The carriage member includes a pair of pivotably mounted and oppositely disposed roller assemblies. The roller assemblies are interconnected to the carriage member such that, dependant upon the direction the carriage member is being translated, they are caused to pivot toward or away from the elongate fill tube which is supported therebetween. A valve mechanism is mounted to the support frame and coupled to fill the tube. The valve mechanism is interconnected to the carriage member so as to govern the amount of material discharged therefrom.

26 Claims, 12 Drawing Sheets

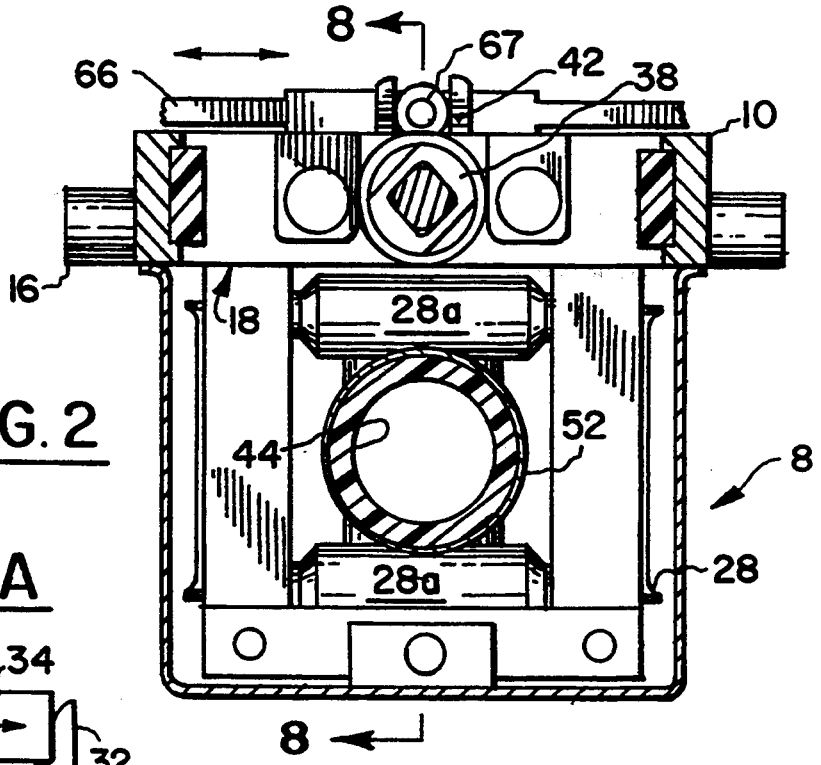
FIG. 2
FIG. 10A
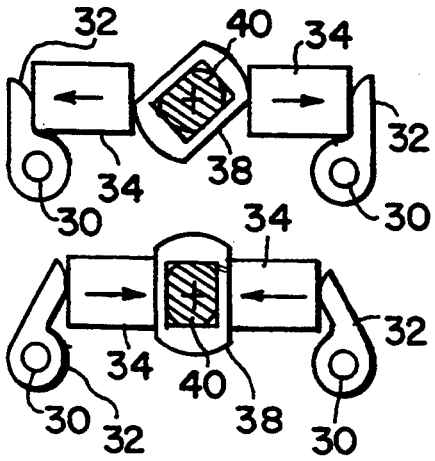
FIG. 10B
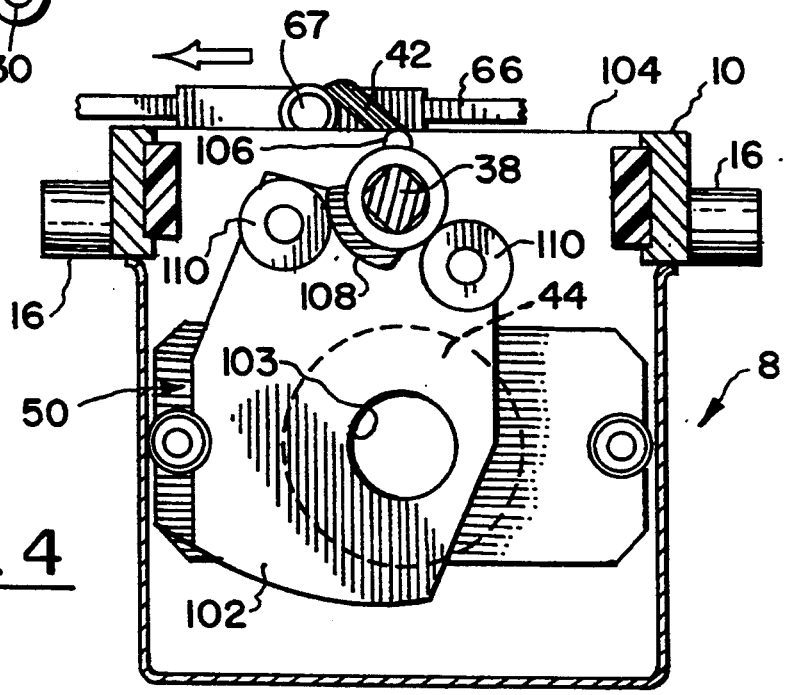
FIG. 4

PERISTALTIC ACTION PRECISION PUMP FILLER

FIELD OF THE INVENTION

This invention relates to apparatus for dispensing directly into containers measured amounts of fill products, and, more particularly, a peristaltic action pump, and valve assembly cooperative therewith, for precisely dispensing said products into containers while maintaining the sterility of the dispensed product. The invention is especially suitable for use in filling containers with food products such as fruit chunks.

BACKGROUND OF THE INVENTION

Presently, known state-of-the-art dispenser/filler utilize a cylinder and piston arrangement with an inlet valve for introducing material and an outlet valve for expelling the material. While this arrangement has proven satisfactory in the past as it provides a generally reliable system with a high degree of volume control, it presents several distinct drawbacks. For example, the cylinder and piston apparatus contains crevices and stagnant flow packets that present prime areas in which bacteria can grow and, accordingly, present a sanitary risk and, worse, a health risk. The above apparatus also depends on various sealing techniques which further pose sanitary, and therefore health risks as the seals utilized frequently wear out and leak, again providing perfect breeding places for potentially harmful bacteria. As can be easily understood, the uncontrolled growth of bacteria germs can be especially dangerous when processing products requiring a high degree of cleanliness.

While it is generally the practice to routinely clean the presently known fillers on a daily basis, more extensive and thorough cleaning is periodically required. It is not uncommon for this procedure to require in excess of 30 hours to complete. Obviously, the resulting down time of the apparatus combined with the costs of labor involved in performing the service can lead to increased cost of the final product.

Ideally, a filler should operate such that the material first introduced is the material first expelled (the FI-FO principle; first in, first out) to avoid the possibility that stagnant pockets of product may occur which result in sanitary problems. It is known that a peristaltic pumping device (either roller type or cam type) can provide such results. However, presently know peristaltic pumping devices are not satisfactory from the standpoint of accuracy of delivery, especially when volumes other than defined by the spaces in the tube along the path of a squeeze roller is required. Also since bare plastic tubing of a relatively soft grade is frequently utilized, both temperature and pressure variations, especially at the intake, will vary the quantity delivered. Even if a fabric covering (generally of a helical woven material) is provided as a sheath for the plastic tubing, variations in either temperature or pressure, or both, are likely to occur. Still further, most generally well known peristaltic action pumps utilize a roller assembly of some type which is revolved so as to squeeze a flexible tube against a wall surface. This is less than satisfactory, as the rolling/squeezing action of the roller assembly is directed against one surface of the tubing containing the material being pumped. Accordingly, certain areas of the tubing are submitted to added stresses and strains.

A further problem incurred by presently know peristaltic pumps, is the flow condition encountered at the delivery point which is generally a nozzle of some kind. Depending upon the viscosity of the material, the air entrained in the material, and the distance between the pumping device and the nozzle, varying degrees of nozzle "drool" may result. That is, some of the product delivered from the tubing may not actually wind up as fill in the intended receptacle but, remain in the form of strands on the end of the tubing. These strands can easily become contaminated before the next discharge of material thereby contaminating that fill and, potentially, subsequent fills.

Still further, the above condition can present problems with sanitation in the event that the containers being filled must be closed by heat sealing a foil or membrane ave their openings. The likelihood of a deflective seal caused by the "drool" and subsequent product spoilage is quite high if the sealing surface is contaminated by product.

SUMMARY OF THE INVENTION

Briefly described, a peristaltic action pump apparatus for accurately measuring and dispensing products into containers while maintaining the sterile quality of the product being dispensed, in accordance with the present invention includes a passageway for the material being dispensed which is provided by a flexible elastomeric tube which is surrounded by a fabric sock whose threads are woven circumferentially rather than helically.

The elastomeric tube/fabric sock passageway is vertically mounted to a support frame. Opposed pairs of rollers are mounted to the frame and about the tube/-sock passageway. The rollers are translatable up and down the frame and pivotal toward and away from each other. The distance over which the rollers pivot (the stroke) is adjustable. The opposed rollers enable precise dispensing (metering) of the fill material and reduce wear on the tube/fabric sock passageway.

A valve mechanism is mounted to the frame in juxtaposition to the discharge end of the tube/sock combination and is cooperatively connected to the rollers so as to co-act therewith upon movement of the roller. That is, at certain points of travel of the rollers along the tube/sock combination the valve mechanism is either open or closed. The points at which the valve mechanism is open or closed is precisely controlled according to the specific location of the rollers.

The valve mechanism may be constructed so as to ensure that no particulate matter of the material being dispensed is left handling after the material has been dispensed, thereby avoiding drool.

The fabric sock is woven from a material which possesses sufficient strength such that the radial dimension of sock itself is not adversely affected by changes in pressure and temperature and therefore, remains substantially constant. Further, the selected sock material is, generally, not affected by age and, therefore, should last indefinitely.

BRIEF DESCRIPTION OF THE DRAWINGS

FIG. 2 is a sectional view taken along line 2—2 of FIG. 1;

FIG. 4 is a sectional view taken along line 4—4 of FIG. 3 and showing the delivery valve in the open position;

FIGS. 10A and 10B are schematic views of the cam tappet and lever for actuating the roller carriage assembly;

DETAILED DESCRIPTION

Figure 6:
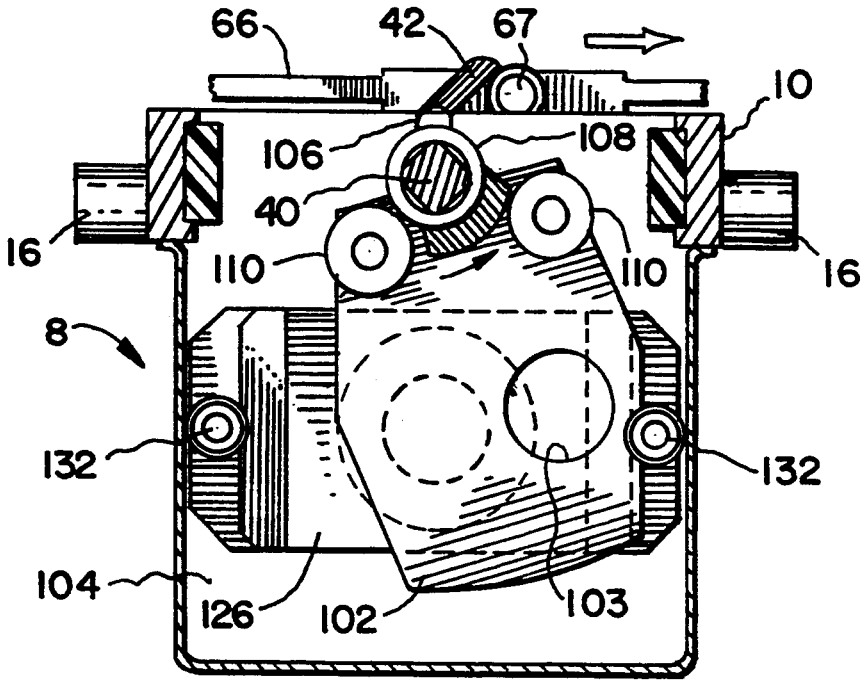
FIG. 6 is a sectional view taken along line 6—6 of FIG. 5 and showing the delivery valve in the closed position.
Figure 7:
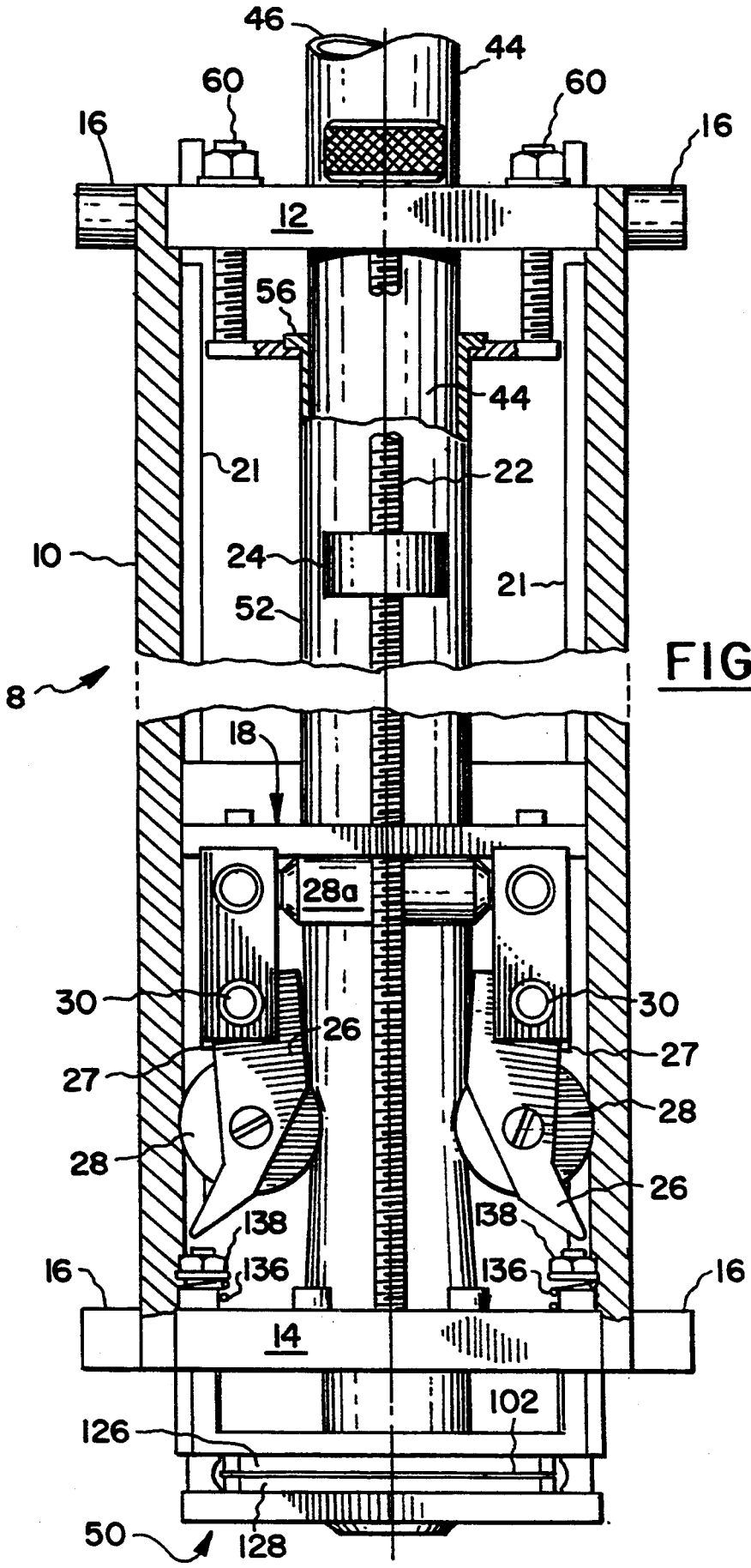
FIG. 7 is a view similar to FIG. 5 but, showing the rollers in the open position at the bottom of their travel and ready to return to the start position.
Figure 8:
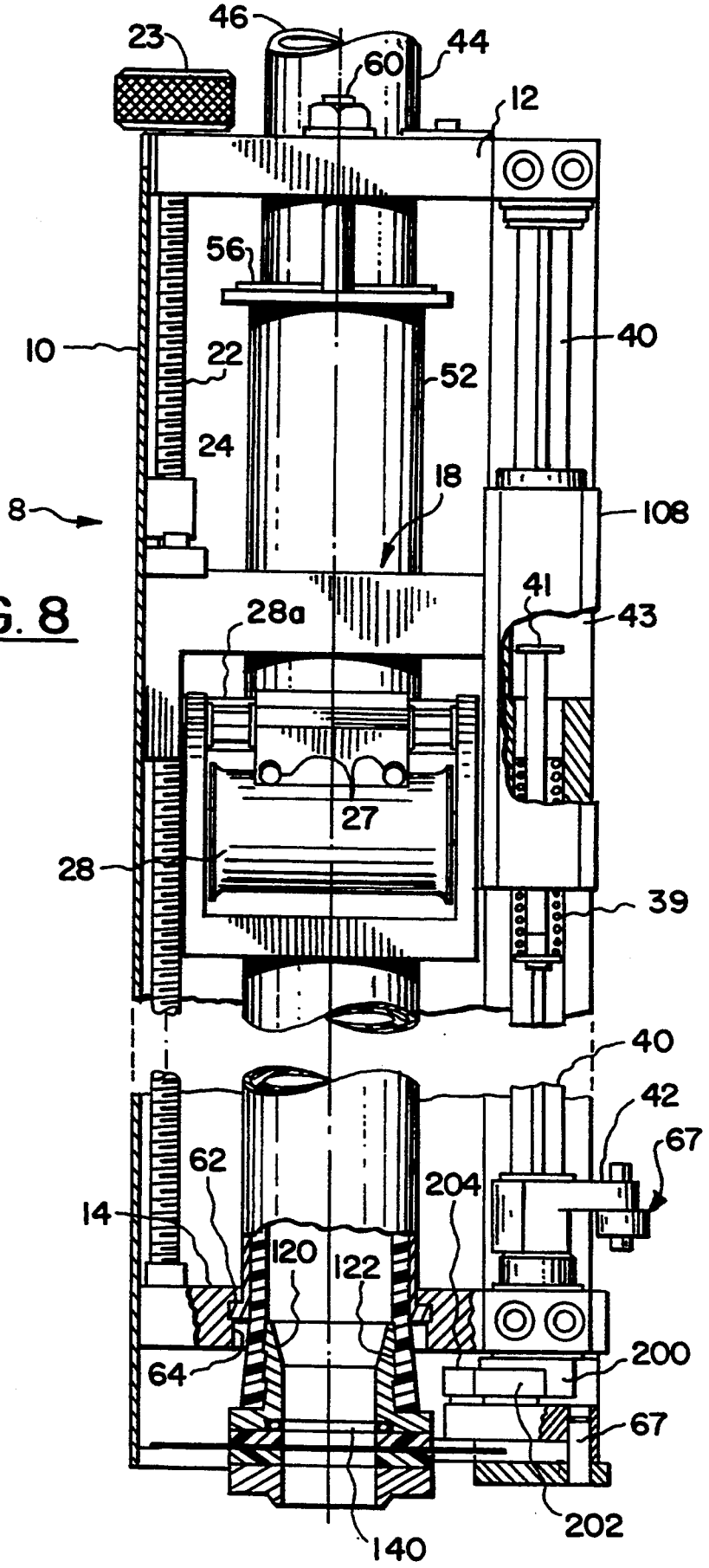
FIG. 8 is a sectional view taken along line 8—8 of FIG. 2.
Figure 9:
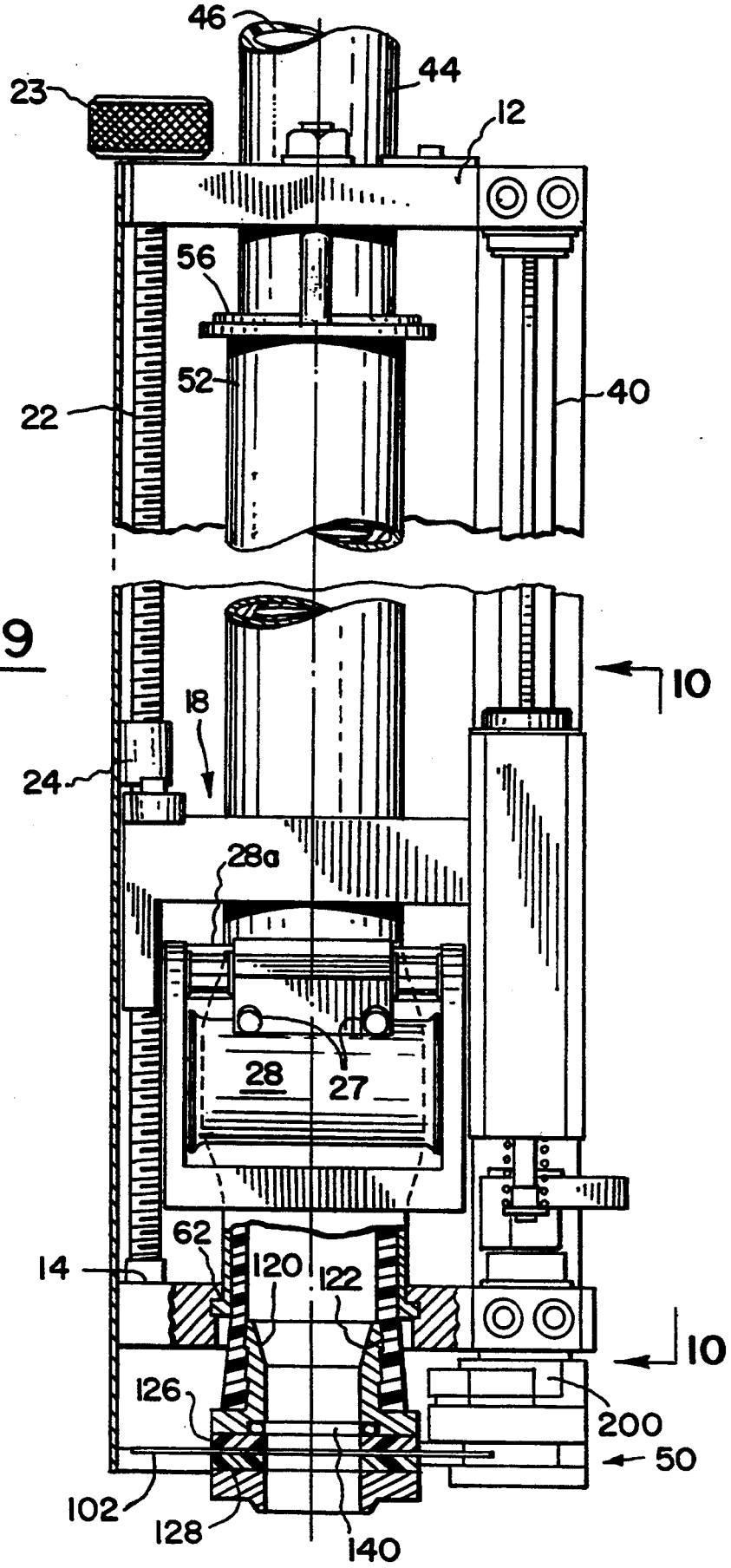
FIG. 9 is a sectional view similar to FIG. 8, but showing some components in greater detail.

Referring now to the drawings, there is shown in FIGS. 1–10 a first embodiment of the peristaltic action precision pump filler according to the present invention. Basically, the pump filler module comprises a support frame 10 having a top plate 12, and a bottom plate 14 and a plurality of cylindrical guide members 16 mounted, approximately, to its exterior corners. Guide members 16 are engaged, and accurately positioned, by appropriate reference members of a multi-station Dower frame, the details of which will be more fully described hereinafter. Frame 10 further includes a roller carriage 18 mounted for vertical translation therealong by way of linear guides 21. A threaded shaft 22 having a thumb wheel 23 is journalled between top plate 12 and bottom plate 14 and in threaded engagement with nut block 24, as best seen in FIGS. 8, and 9 and is generally positioned to limit the travel of the roller carriage 18.

Figure 10:
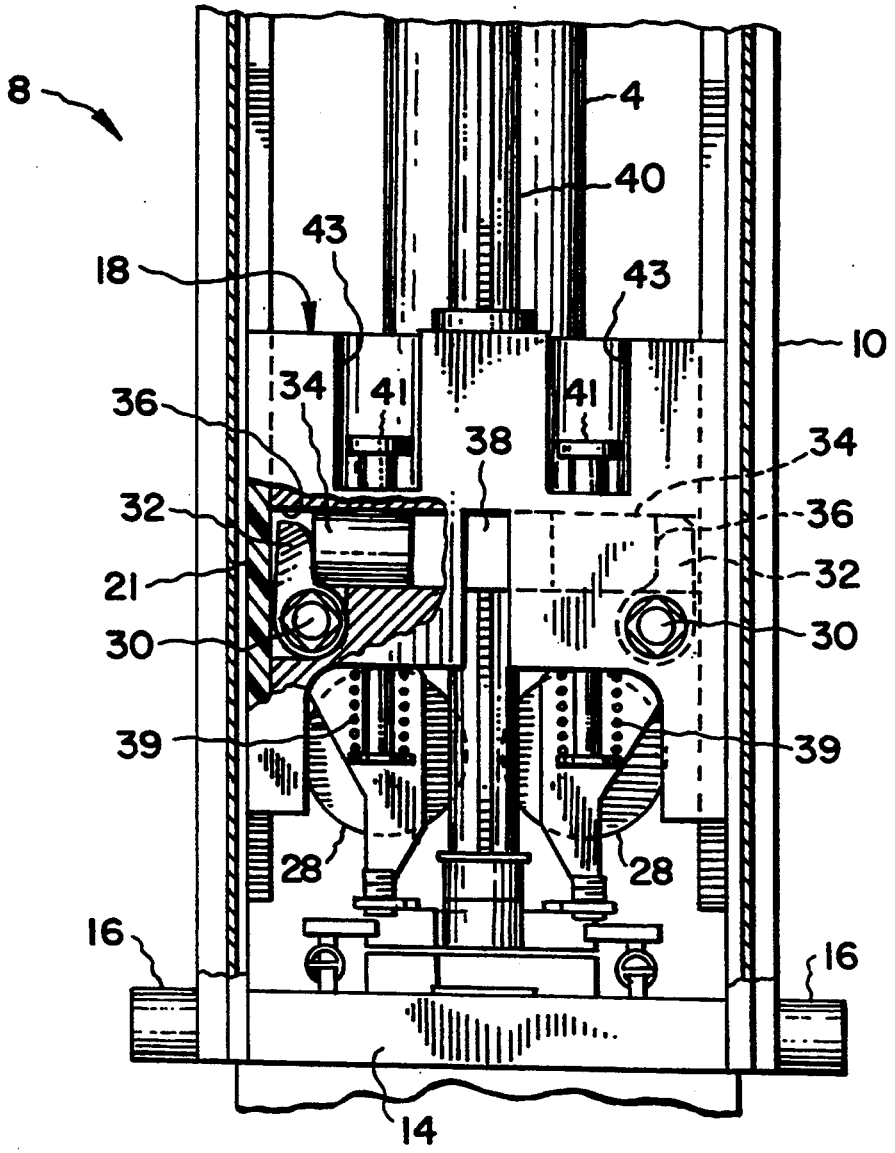
FIG. 10 is a partially broken away sectional view of FIG. 9 looking in the direction indicated by the arrows of line 10—10.

A pair of levers 26 each carrying on elongate roller 28, are mounted to roller carriage 18 by way of shafts 30 which are journalled for oscillation to roller carriage 18. The stroke (pivotal displacement) of the levers is adjustable using bolt 27. Further, as best seen in FIGS. 10, 10A and 10B each shaft 30 has a rocker arm 32 fixed thereto which is in contact with one end of a tappet 34 slidably received within bore 36 formed in roller carriage 18. The opposite end of each tappet 34 is in contact with a cam 38 which is itself slidably mounted to an elongate shaft 40 journalled for oscillation between upper plate 12 and lower plate 14, as best seen in FIGS. 8, 9, and 10. Roller carriage 18 further includes a pair of headed pins 41 which are biased to the carriage by way of springs 39. The heads of pins 41 are exposed in slots 43.

A slotted actuator arm 42, as best seen in FIGS. 2, 6, 8, and 9, is mounted to elongate shaft 40 adjacent the lower plate 14. Arm 42 may be oscillated back and forth approximately 90 degrees between a first position (as indicated by FIG. 4) and a second position (as indicated by FIG. 6). The significance of these positions will be more fully detailed later in this description.

Figure 1:
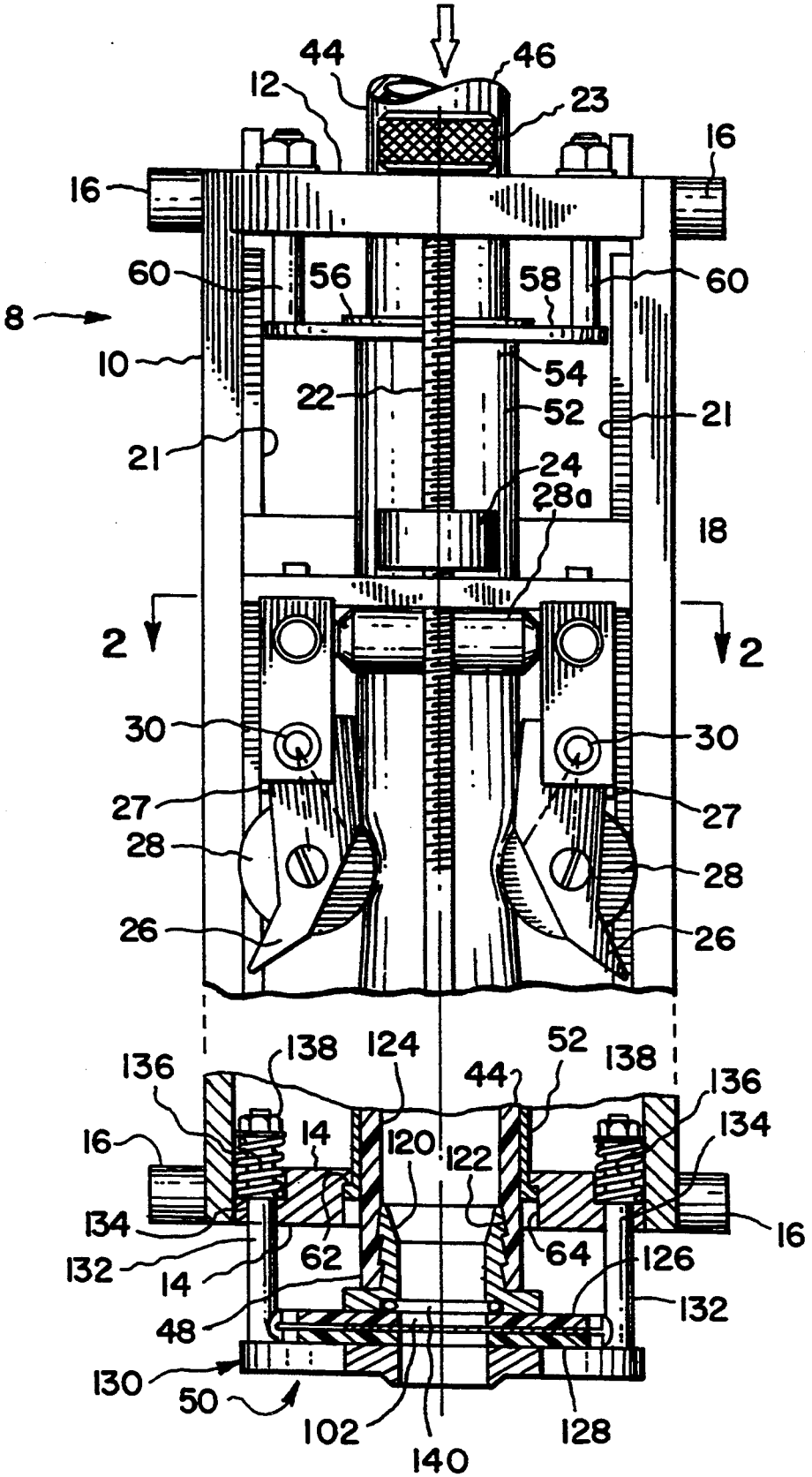
FIG. 1 is a partially broken away and sectioned front view of the peristaltic action precision pump filler at the beginning of the fill procedure wherein the rollers are in the open position away from the fill tube.
Figure 5:
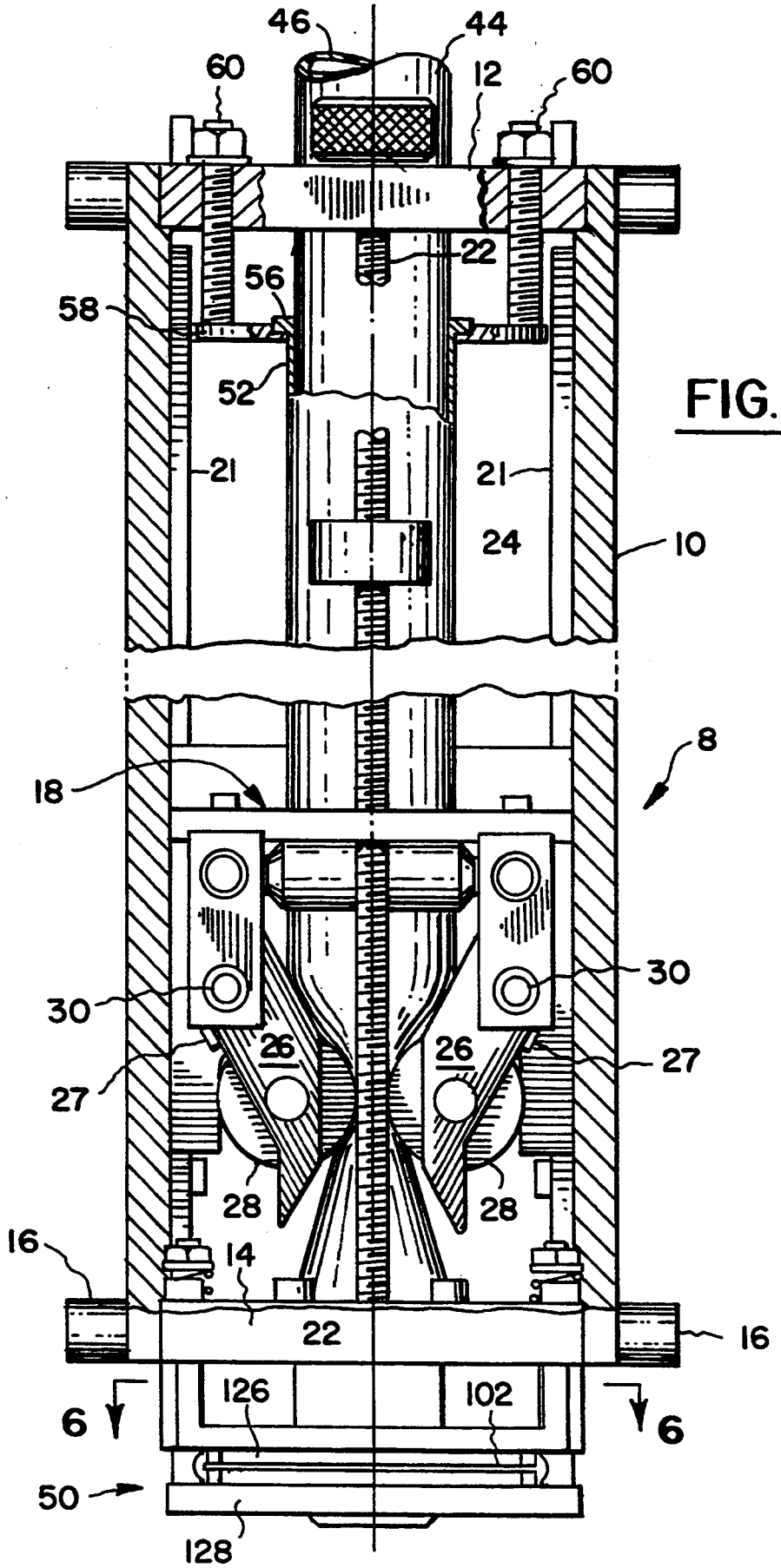
FIG. 5 is a view similar to FIG. 3 but, showing the rollers in the closed position and at the bottom of their travel along the fill tube.

An appropriately dimensioned (for the volume to be dispensed) flexible fill tube 44 is disposed in the support frame 10 generally between the top plate 12 and bottom plate 14. Further, fill tube 44 is encompassed by the roller carriage 18 such that roller 28 are disposed on opposite sides of the fill tube 44. As best illustrated in FIGS. 1 and 5 the upper end 46 of fill tube 44 is appropriately positioned in frame 10 so as to be in communication with a batch supply of fill material to be dispensed in an accurately measured amount into appropriate pre-selected containers positioned below the lower, or discharge, end 48 of fill tube 44 which is mounted through bottom plate 14 so as to be in close juxtaposition to a material delivery control valve 50. A flexible but, non-elastic sock-like sheath 52 is mounted over and closely about the periphery of fill tube 44. Its upper end 54 includes a flange 56 which is mounted to an annular plate 58 adjustably suspended from top plate 12 by way of adjusting studs 60. The lower end of sock-like member 52 includes a flange portion 62 which is received by an annular recess 64 formed in lower plate 14.

As previously referenced, actuator arm 42 is mounted to elongate shaft 40 and is oscillated 90 degrees back and forth between two positions. A bar 66 is pivotally coupled to actuator arm 42, by way of a pin and roller assembly 67, as best seen in FIGS. 2, 4, 6 and 8 and is slidable in a back-and-forth manner, as indicated by directional arrow 68 in FIG. 2. Thus, as bar 66 is moved in the direction shown in FIG. 4, actuator arm 42 pivots about its axis, as indicated. In turn, elongate shaft 40, to which arm 42 is mounted, is caused to rotate the same amount. Therefore, as bar 66 is moved in the direction indicated in FIG. 6, shaft 40 is caused to rotate back a like amount which, in this application, is approximately 90 degrees.

A delivery control valve for accurately controlling the amount of product dispensed for fill tube 44 is cooperatively mounted to and below support frame 10, as best seen in FIGS. 1, 4, 6, 8 and 9. In particular delivery control valve 50 comprises an elongate valve plate 102 having an aperture 103 which is pivotally secured to mounting plate 104 by way of pivot pin 106. A further cam 108 formed on elongate cam 40 as best illustrated in FIGS. 4 and 6, is disposed so as to be in engagement with a pair of roller assemblies 110 mounted on valve plate 102. With shaft 40 in the position illustrated in FIG. 4, cam 108 engages rollers 110 which causes valve plate 102 to be pivoted about pivot pin 106 to a position such that aperture 103 is located substantially in alignment with discharge end 48 of fill tube 44. As shaft 40 is rotated to a position as represented in FIG. 6, valve plate aperture 103 is rotated so as not to be in alignment with fill tube discharge end Adapter ring 120 having a barbed extension 122 attaches to bottom plate 14 of support frame 10, as shown in FIGS. 1, 8 and 9. Barbed extension 122, which fits within the bore 124 of fill tube 44 is dimensioned such that a close and very tight fit between the two results. As best seen in FIG. 1, a pair of plates 126, 128 having good dry lubricating qualities are disposed on opposite sides of control valve plate 102. One side of valve plate 126 bears against adapter ring 120 while its other side is slidably received on one surface of valve plate 102. One side of plate 128 is held against the other side of valve plate 102 by a pressure plate assembly 130 which bears against its opposite side. Pressure plate 130 is attached to lower plate 14 by way of a pair of elongate studs 132 which pass through apertures 134 therein. A coil spring 136 is fitted about each stud 132 and bears against a nut 138 on one end and bottom plate 14 on the other. Thus, pressure plate 130 exerts a fairly constant force against slide plates 126, 128 which bear upon valve plate 102. Plates 126 and 128, as well as pressure plate 130 include apertures which are of substantially the same diameter as that of the bore 124 of fill tube 44. An O-ring 140 may be fitted to adapter ring 120, as shown, in order to ensure a tight seal between it and slide plate 126.

Figure 11:
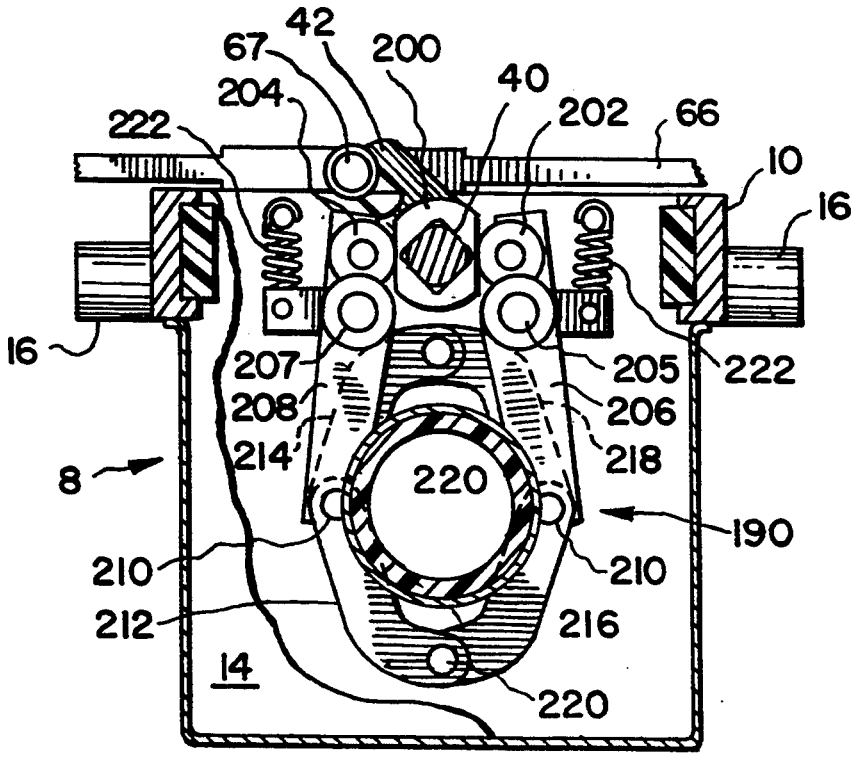
FIG. 11 is a sectional view similar to FIG. 4 but showing a further embodiment of a delivery valve in the open position according to principles of the present invention.
Figure 12:
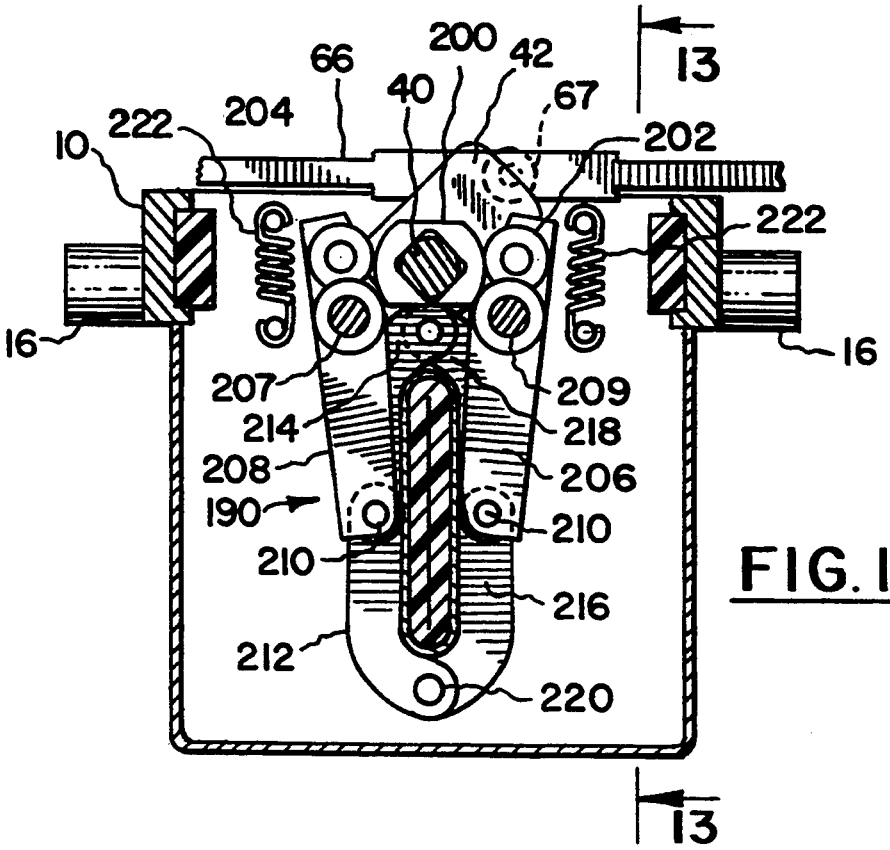
FIG. 12 is a view of the valve shown in FIG. 11 but, in the closed position.
Figure 13:
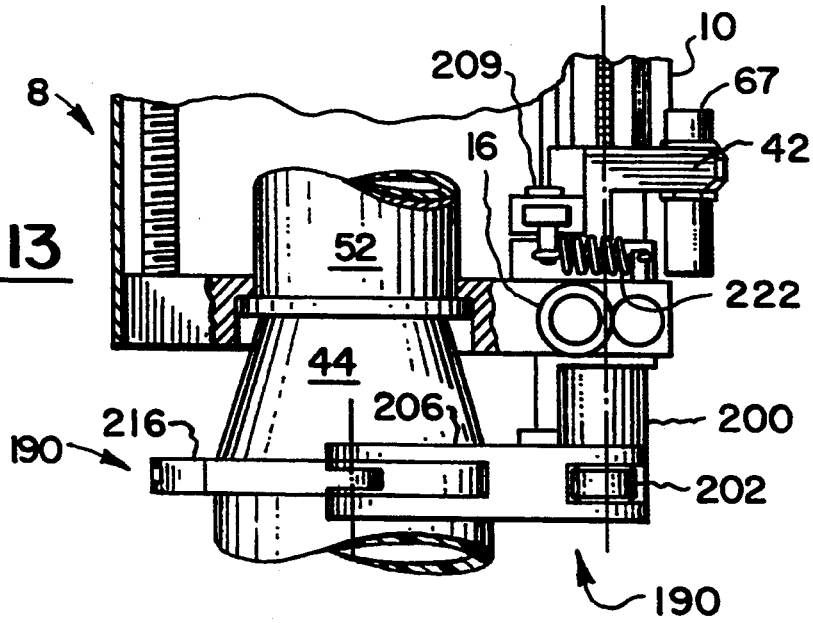
FIG. 13 is a sectional view taken along line 13—13 of FIG. 12.

A further embodiment of delivery control valve 190 for a peristaltic action precision pump filler according to the present invention is set forth and illustrated in FIGS. 11–13. However, in this application, as the support frame 10 which holds the fill tube 44, roller carriage 18, etc., is essentially the same as that already shown and fully described in FIGS. 1–10, there is no need for a repeated detailed description of those like parts. Accordingly, only the alternate embodiment of the delivery control valve and its function will be described in detail.

It will be seen that a cylindrical cam 200 with opposed flattened sides is mounted to elongate shaft 40 below bottom plate 14 so as to be in contact against a pair of rollers 202, 204 which are rotatably secured to approximately one end of crank arms 206, 208, respectively. Crank arms 206, 208 are pivotally mounted to, respectively, shafts 207, 205 which, in turn are mounted to bottom plate 14. The ends of crank arms 206, 208 opposite rollers 202, 204 are joined together in a hinge manner by pins 210 to links 212, 214 and 216, 218, respectively. Further link 212 is joined to link 216, and link 214 to link 218 by pins 220 to form a parallelogram. As illustrated, a spring 222 is mounted between each crank arm and bottom plate 14. As shaft 40 is rotated, cylindrical cam 200 is caused to rotate which, in turn, engages rollers 202, 204 on respectively crank arms 206, 208 causing them to pivot about shafts 207, 209. The parallelogram arrangement of the interconnected links results in the links assuming an "open valve" position as shown in FIG. 11 and a "closed valve" position shown in FIGS. 12 and 13. While cam 200 causes the links to assume the closed position, springs 222 force the valve to the open position.

Figure 14:
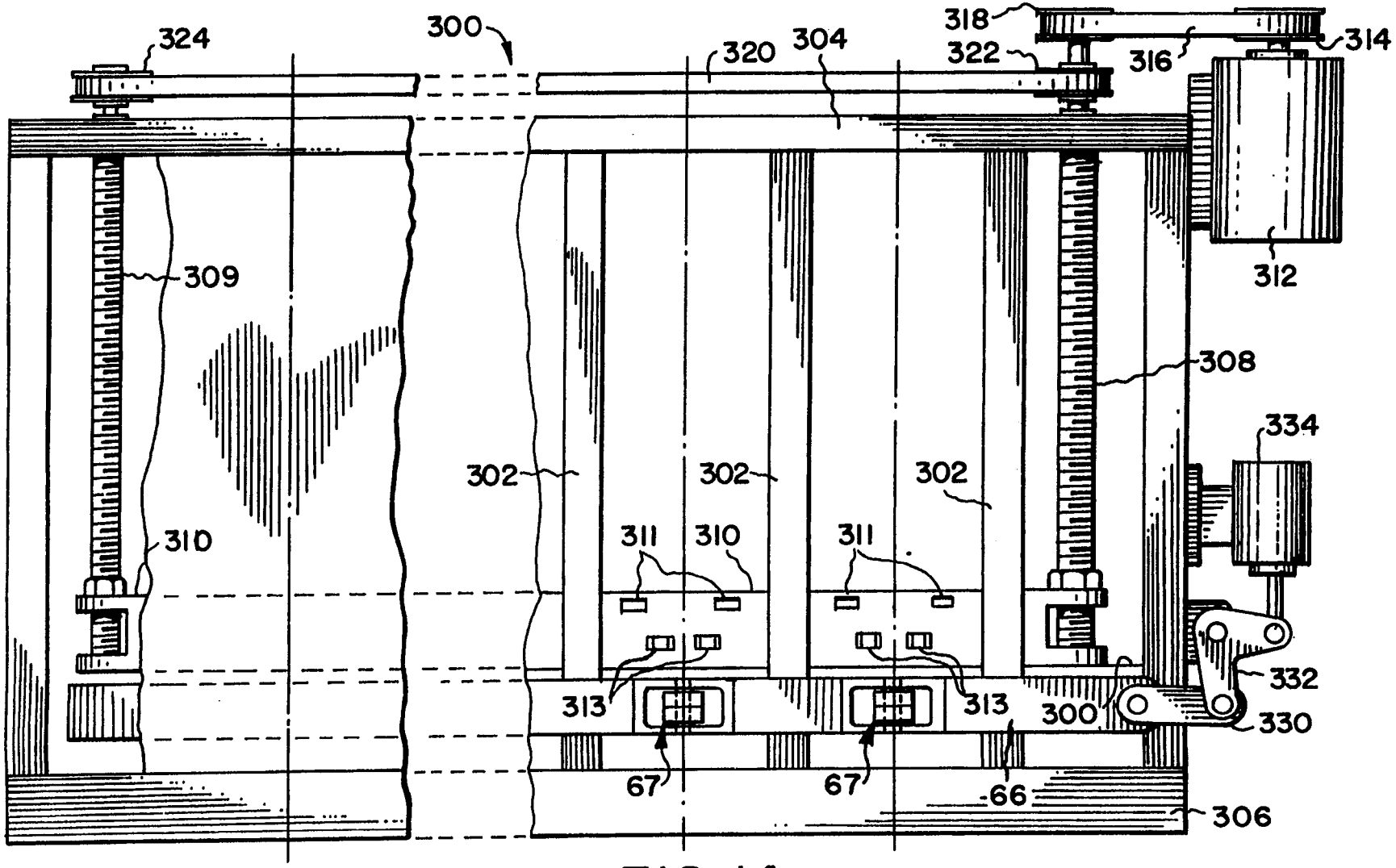
FIG. 14 and 15 are generally schematic front and side views, respectively, of an appropriate mounting frame and actuating mechanism for the peristaltic action precision pump filler according to the present invention.
Figure 15:
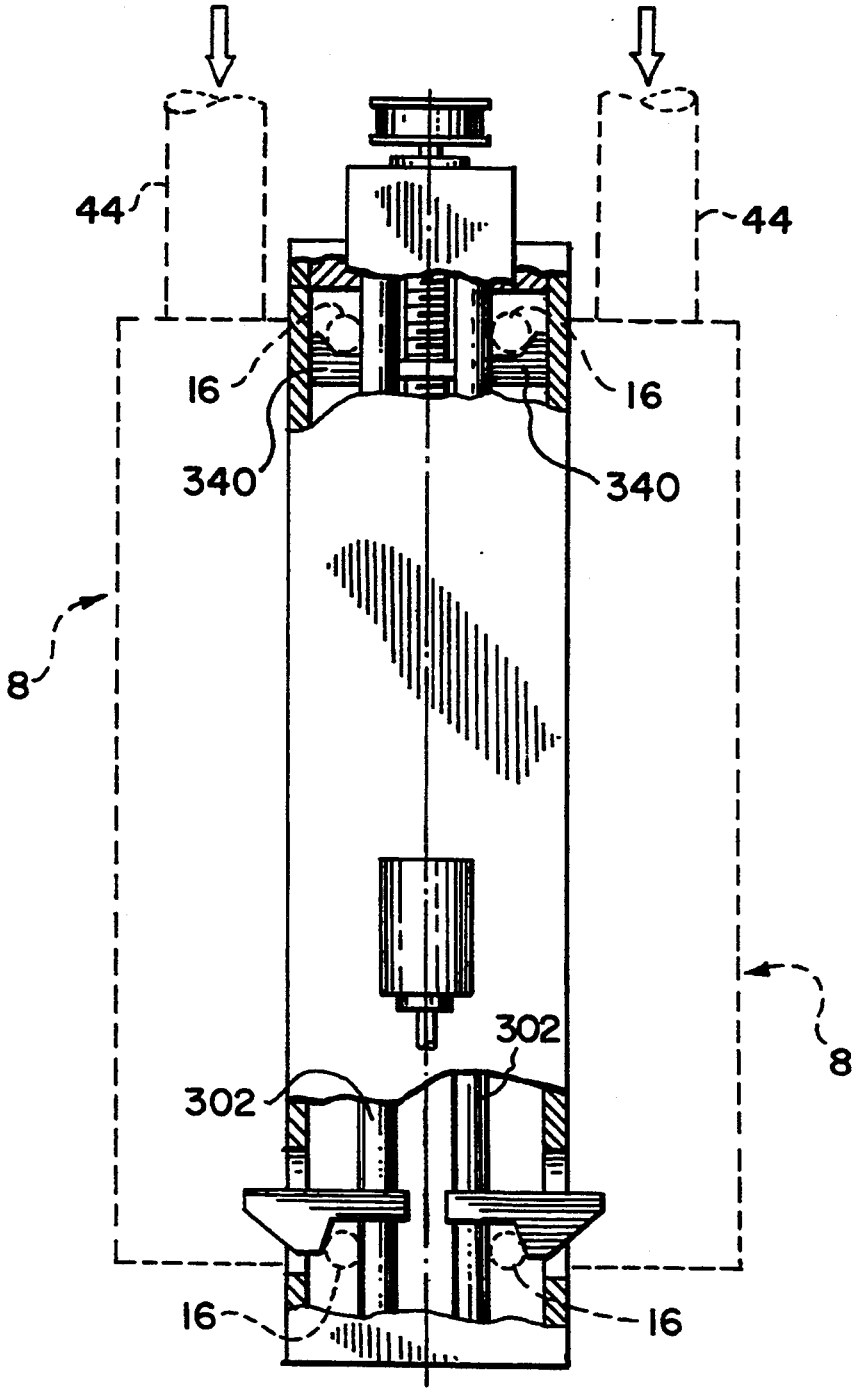

As referenced earlier in this specification a plurality of the peristaltic action precision pump fillers 8, according to the principles of the present invention, are mounted in and actuated by a multi-station power frame 300, as shown in FIGS. 14 and 15. Power frame 300 comprises multiple pairs of vertical bars 302 spaced parallel to each other and connected between a top mounting plate 304 and bottom mounting plate 306. A pair of linear drive screws 308, 309 are disposed at opposite ends of power frame 300. Each is journalled through top plate 304 and rotatably received at its lower end by power frame 300. An elongate bar 310 is cooperatively connected between linear drive screws 308 and 309 as shown in FIG. 14. Bar 310 includes four horizontally protruding extensions for each individual peristaltic action pump filler 10 to be mounted in the multi-station frame 300. Of these, the upper extensions 311 are designed to engage the top of roller carriage 18 while the lower extension 313, which are bifurcated, fit under and are engaged by the heads of pins 41 of the roller carriage 18.

A stepping or servo, motor 312 having a pulley 314 is appropriately mounted to frame 300 and is connected by way of toothed belt 316 to a complimentary pulley 318 carried by linear drive screw 308. A further toothed belt 320 is mounted between a second pulley 322 mounted to screw 308 and pulley 324 carried by drive screw 309.

The slotted actuator arm 42 mounted to elongate shaft 40 of roller carriage 18, as previously referenced, is engaged by the pin and roller assembly 67 of reciprocating slide bar 66. In turn, slide bar is connected by way of a pivot link 330 to a crank arm 332 which is, in turn, connected to, and activated by, a cylinder 334.

Having described the relationship and inter-connection of parts of the peristaltic .action precision pump filler, its operation now will be fully described.

By referring to FIGS. 14 and 15, it will be appreciated that a substantial number of peristaltic action precision pump fillers 8 according to the present invention may be supported by the multi-station frame 300. Further, as best seen in FIG. 15 peristaltic action pump fillers 8 may be easily added to or deleted from the multi-station frame 300 by first, simply placing the cylindrical guide members 16 located adjacent top plate 12 into engagement with hook blocks 340 which are fixed, generally, to the upper portion of multi-station frame 300. Thereafter, the cylindrical guide members 16 located adjacent lower plate 14 are latched into position between hook blocks 342, which are spring-biased and pivotally mounted to frame 300, and vertical bars 302. Thus, support frame 10 (or a plurality thereof) is accurately positioned within and fully supported by the multi-station frame 300.

Thereafter, horizontal projections, or extensions, 311, 313, as best seen in FIG. 14 are appropriately fitted to roller carriage 18. That is, upper projections 311 are disposed at the top of the carriage 18 while lower bifurcated projections 312 are fitted under the heads of headed pins 41. Springs 39, which bias the pins to the carriage, compress slightly when the carriage is attached due to the restraint of protrusions 311, 313. Thus, carriage 18 is held without lash in position in frame 300.

With the peristaltic action precision pump filler 8 in place in the multi-station frame 300, it is merely necessary to connect the flexible fill tube 44 to the batch supply of material to be dispensed. Thereafter, the process of filling individual containers disposed below the individual pump filler 8 is ready to commence. The first step of the procedure is shown in FIGS. 1 and 2 wherein the flexible fill tube 44 has been connected to the batch supply of fill material, the filler carriage 18 is in the full upward position on linear guides 21 with elongate rollers 28 pivoted by way of levers 26 away from contact against fill tube 44 and sock-like sheath 52 which closely surrounds same. In this position, plate valve 102 is closed, as is shown in FIG. 6. It is when roller carriage 18 is in the position shown in FIG. 1 and 2 that the determination is made as to the amount of material to be injected into the flexible fill tube 44. Generally, the adjustment is accomplished by operating the motor 312 to bring the bar 310 to the desired height along carriage 18. Thereafter, precise adjustment is accomplished-through altering the position of nut block 24 which effectively changes the stop position of travel of carriage 18 against spring 39.

Figure 3:
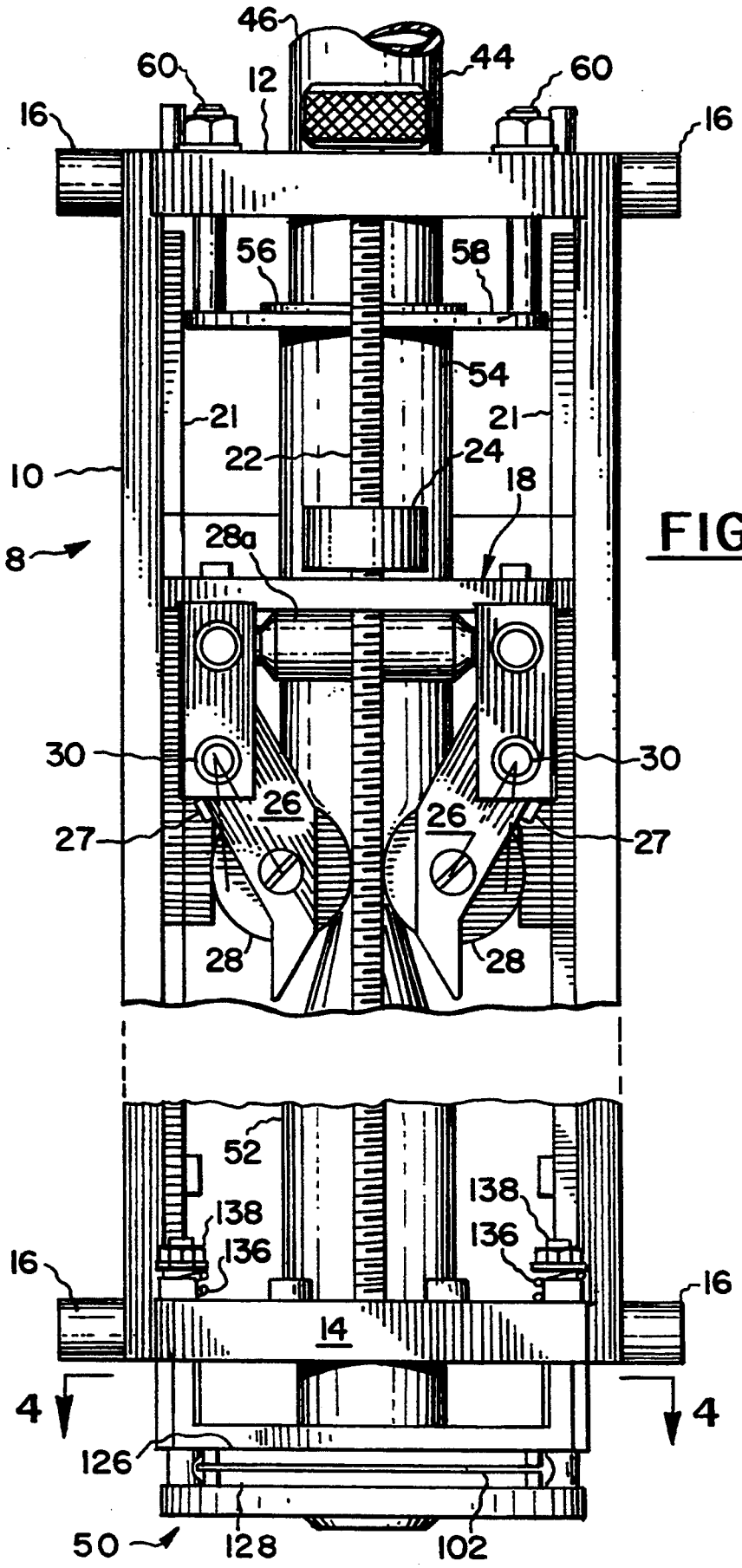
FIG. 3 is a view similar to FIG. 1, but showing the rollers in the closed position against the fill tube after introduction of product into the fill tube.

Once the selected material has been introduced to fill tube 44, rollers 28 are closed, stepper motor 312 is energized which rotates linear screws 308, 309 through their inter-connection with pulleys 314, 318, 322 and 324 and toothed belts 316 and 320. Elongate bar 310, which is mounted to linear screws 308, 309, causes roller carriage 18 to translate along linear guides 21 of frame 10. As this occurs, cylinder 334 is activated causing crank 332 to move slide bar 66 horizontally. Slotted actuator arm 42, as previously mentioned, is connected to slide bar 66 and to cam 40 by way of pin and roller assembly 67. As slide bar 66 moves horizontally, actuator arm 42 pivots about pin and roller assembly 67 thereby rotating elongate shaft 40 and cam 38 mounted thereto. By referring to FIGS. 3, 10, 10A and 10B it is readily seen that rotation of cam 38 results in movement of tappets 34 in bores 36 of roller carriage 18. Tappets 34 thereby exert a force against rocker arms 32 and, as they are pivotally fixed to levers 26 by way of shafts 30, they are caused to pivot about the shafts forcing rollers 28 against the sock-like sheath 52/fill tube 44 combination, as best seen in FIG. 3. In this position, roller carriage 18 is still at the pre-designated upward position in frame 10. At this time, (after fill material flows into tube 44 and rollers 28 are closed), valve plate 102 opens, as best seen in FIG. 4. As previously referenced, valve plate 102 is pivotally fixed to mounting plate 104 by pivot pin 106 such that cam 108 rotates with cam 38, which in turn, engages rollers 110.

Thereafter, stepper motor 312 is energized and linear screws 308, 309 translate elongate bar 310, to which roller carriages 18 are mounted, downward. As rollers 28 are squeezing the sock-like sheath 52/fill tube 44 combination, material inside is forced out through valve plate aperture 103 and into appropriate receptacles (not shown) positioned therebelow.

When roller carriage 18 has completed a full downward stroke, (as best seen in FIG. 5) and the predetermined amount of material has been ejected, valve plate 102, through its interconnection to cylinder 334, slide bar 66, pivot 67, actuator arm 42, shaft 40 and cam 108 is pivoted to the closed position (as best seen in FIG. 6). The scissors-like action of valve plate 102 acts to cut the flow of material from tube 44. This is important if a fibrous material, such as pineapple, is involved. The cutting action cleanly shears any potential strands of material, thereby preventing "drool". Thereafter, rollers 28 are rotated to the open position (as shown in FIG. 7) and the roller carriage 18 returns to its full upward location ready to begin another fill procedure. As carriage 18 descends, fresh material flows into and fills the now empty area of the tube positioned behind the rollers 28.

As mentioned previously, sock-like sheath 52 is constructed from a flexible but, non-elastic material. This is quite important, as the non-elastic features and the close fit about elastic fill tube 44 prevent the fill tube from expanding as material is injected and as rollers 28 are moved downward along the tube. It has been found that a ,sock manufactured from Kevlar, a product of Du-Pont De Nemours, Inc. works extremely well as it shows no sign of stretch, either radially or longitudinally.

Further, it may be desirable to equip roller carriages 18 with an auxiliary pair of opposed, non-pivotable rollers **28*a*, as best seen in FIGS. 1 and 2. These rollers would mount upward on roller carriage 18 from pivoting rollers 28 and would be designed to just contact the sock 52/tube 44 combination thereby removing any ovality which may occur due to the pressure exerted by the full contact of rollers 28**.

Still further, as referenced earlier herein, frame 10 is equipped with a threaded shift 22 having a nut block 24 fitted thereto. As will be appreciated, nut block 24 may be moved up or down on threaded shaft 22 by way of thumb wheel 23 and, therefore, either away from or closer to roller carriage 18. Thus, the upward travel of carriage 18 may be adjusted.

Additionally, while prevention of "drool" has been described in one manner, it may be also achieved by programming the stepper, or servo, motor 312 to reverse thereby moving the rollers 28 away from the delivery valve after completion of the downward stroke and just before the valve is closed. This effectively pulls, or sucks, the product being dispensed back from the valve opening, thereby preventing product drool.

Also, in some cases , such as when dealing with low viscosity products, it may be desirable to open the delivery valve only partially as the rollers travel downward along the product tube. By so doing, a positive pressure is retained in the tube which, in turn, prevents air from entering thereby adversely effecting the volumetric accuracy of the following delivery.

Further, it may be desirable to substitute a hydraulic cylinder in place of the stepper, or servo, motor described above. Likewise, the rollers and control valve may be activated by a separate hydraulic cylinder.

Lastly, it may be desirable when dispensing low viscosity products to reduce the diameter of the product tube at or beyond the position of the delivery control valve. This results in better flow control of the product which assists in reducing, or eliminating, splashing and surging. This is desirable when filling from the bottom of the container upward. That is, when the delivery tube is inserted into the container and thereafter simultaneously raised as the filling procedure begins. This prevents air inclusion in the product itself which results in short weight or potential problems in sealing as the result of material being deposited on the rim of the container.

From the foregoing, it is evident that various modifications may be made by those of skill in the art without departing from either the spirit or scope of the invention set forth herein. Therefore, all matters shown and described herein are meant to be illustrative and should not interpreted in a limiting sense.

It is claimed:

1. A peristaltic action pump filler for accurately measuring and dispensing a pre-determined amount of fill material into containers disposed therebelow, comprising:

a) a support frame having upper and lower ends, said ends including mounts thereon;

b) an elongate, elastic flexible fill tube having a fill end and a discharge end, said tube being generally disposed between said upper and lower ends of said support frame;

c) a flexible, non-elastic tubular member disposed about said elastic tube so as to closely encompass same, said flexible non-elastic tubular member including mounting means for mounting to said upper end mount and said lower end mount of said support frame;

d) a carriage member cooperatively mounted to said support frame for reciprocating longitudinal movement therealong between said upper and lower mounts, said carriage member including pivoting roller means disposed so as to be positioned on opposite sides of said flexible, non-elastic tubular member and pivotal toward and away therefrom;

e) means cooperatively mounted to said support frame and said member for imparting said reciprocating longitudinal movement of said support member;

f) valve means mounted to said lower end of said support frame adjacent said discharge end of said flexible fill tube and pivotable between open and closed positions; and g) actuating means mounted to said support frame and to said carriage member and coupled to said pivoting roller means and said valve means such that actuation of said actuating means causes said oppositely disposed rollers to pivot toward engagement with or away from said flexible non-elastic tubular member and said valve means to pivot to either an open or closed position.

2. The peristaltic action pump filler as set forth in claim 1 wherein said pivoting roller means comprises elongate roller assemblies.

3. The peristaltic action pump filler as set forth in claim 2 wherein said roller assemblies are mounted to said carriage member by way of oscillating levers.

4. The peristaltic action pump filler as set forth in claim 3 wherein said oscillating levers further include adjustment means thereon coupled to said roller assemblies for adjusting the amount of arc said roller assemblies pivot toward or away from said non-elastic tubular member.

5. The peristaltic action pump filler as set forth in claim 2 wherein said carriage member includes a further pair of roller assemblies oppositely disposed thereon, said further pair being arranged to bear against said non-elastic tubular member.

6. The peristaltic action pump filler as set forth in claim 5 wherein said further pair of rollers is fixably mounted to said carriage member approximately 90 degrees from said pivoting rollers.

7. The peristaltic action pump filler as set forth in claim 1 wherein said flexible non-elastic tubular member comprises a woven sheath constructed from a material whose threads are woven radially rather than helically so as to prevent radial distortion thereof upon introduction of the fill material into said elastic flexible fill tube.

8. The peristaltic action pump filler as set forth in claim 1 wherein said means for imparting reciprocating movement of said carriage member comprises a motor coupled to said carriage member by way of a threaded shaft, said motor being selected from the group consisting of a servo motor and a stepper motor.

9. The peristaltic action pump filler as set forth in claim 8 and further including stop means mounted to said shaft, said stop means being positioned thereon to engage said upper end of said support frame to thereby limit the upward travel of said carriage member.

10. The peristaltic action pump filler as set forth in claim 9 wherein said stop means is adjustably mounted to said shaft whereby the upper limit of travel of said carriage member may be selectively set by altering the position of said stop means.

11. The peristaltic action pump filler as set forth in claim 1 wherein said upper end mounting means of said non-elastic tubular member comprises a flange and said flange is mounted to a support plate suspended from said support frame by way of adjustable studs.

12. The peristaltic action pump filler as set forth in claim 1 wherein said lower end mounting means of said non-elastic tubular member comprises a flange and said flange is received in a plate coupled to said lower end of said support frame.

13. The peristaltic action pump filler as set forth in claim 1 wherein said valve means is mounted to said support frame by a plurality of spring members such that said valve means is held in firm engagement against the discharge end said fill tube.

14. The peristaltic action pump filler as set forth in claim 13 wherein said valve means comprises a plate member having an aperture therein held between a pair of similarly apertured plates having dry lubricating qualities so as to permit said plate member to pivot therebetween.

15. The peristaltic action pump filler as set forth in claim 1 wherein said actuating means includes:

a) an elongate shaft journalled for rotation to said carriage member between said upper and lower ends of said support frame; and b) means cooperatively mounted to said carriage member for coupling said elongate shaft to said pivoting roller means whereby rotation of said elongate shaft causes said roller means to pivot.

16. The peristaltic action pump filler as set forth in claim 15 wherein said means cooperatively mounted to said carriage member comprises:

a) a pair of lever arms, each being pivotally mounted to said carriage member by a shaft rotatably mounted thereto, and said roller means being mounted to said lever arms; and b) a pair of oppositely disposed tappet assemblies, each one of which is disposed in a bore formed in said carriage member so as to be in contact with said elongate shaft on one of its ends and one of said lever arms on its other end, whereby rotation of said elongate shaft moves said tappet assemblies in said bores against said lever arms thereby causing them and the roller means attached thereto to pivot toward or away from said non-elastic tubular member.

17. The peristaltic action pump filler as set forth in claim 16 wherein said tappet assemblies bear against a cam which is slidably mounted in said carriage member on said elongate shaft.

18. A peristaltic action pump for dispensing fill material into containers disposed therebelow, comprising:

a) a support frame having mounting means at its upper and lower ends for providing support to a fill tube to be positioned therein;

b) a carriage member mounted to said support frame for longitudinal reciprocating movement therealong;

c) a pair of roller assemblies mounted to said carriage member opposite from each other and pivotable from an open position to permit positioning therebetween of a fill tube to a closed position whereby said roller assemblies are in engagement against the fill tube;

d) means coupled to said support frame and said carriage member for providing reciprocating longitudinal movement to said carriage member; and e) means mounted to said carriage member and coupled to said means for providing longitudinal movement thereto for pivoting said roller assemblies from an open position to a closed position depending upon the specific location of said carriage assembly in its reciprocating longitudinal travel along said support frame; and f) valve means mounted to said support frame adjacent said lower end thereof and coupled to said means for pivoting said roller assemblies such that as said roller assemblies are pivoted from an open position to a closed position as said carriage assembly travels along said support frame, said valve is caused to move to a position compatible therewith whereby the flow of material from the fill tube positioned in said support frame is accurately controlled.

19. The peristaltic action pump as set forth in claim 18 wherein said pair of roller assemblies comprise a pair of elongated rollers mounted to said carriage assembly such that their axis of rotation is generally perpendicular to the longitudinal axis of said support frame.

20. The peristaltic action pump as set forth in claim 19 wherein said elongated rollers are mounted to said carriage member by levers and said levers are pivotable.

21. The peristaltic action pump as set forth in claim 20 wherein said means for providing longitudinal movement to said carriage member includes a threaded shaft rotatably mounted to said support frame between said upper and lower ends and coupled to said carriage member and drive means connected to said threaded shaft for imparting the correct direction of rotation to said shaft consistent with the location of said carriage member in said support frame.

22. The peristaltic action pump as set forth in claim 18 wherein said valve means comprises a plurality of links pivotally interconnected to each other to form a parallelogram such that upon pivoting certain of said links the remainder are caused to pivot a similar amount whereby the opening defined between the interconnected links is variable from a position where the links are separated from each other to a position where said links are relatively close thereby applying a constricting pressure to a fill tube positioned in said support frame.

23. The peristaltic action pump as set forth in claim 22 wherein said valve means is coupled to said means for pivoting said roller assemblies from an open position to a closed position by an elongate cam rotatably mounted between said support frame's upper and lower ends and said elongate cam being in engagement with crank means pivotally attached to said plurality of links, whereby rotation of said elongate cam causes said crank means to pivot a corresponding amount and said interconnected links forming said parallelogram to, likewise, pivot and thereby vary the opening defined by said interconnected links.

24. The peristaltic action pump as set forth in claim 23 wherein said crank means comprises a pair of crank arms having roller assemblies mounted thereon for engagement with said elongate cam.

25. The peristaltic action pump as set forth in claim 18 and further including an elongate flexible fill tube supported between said support frame's upper and lower ends, said fill tube having a fill end and a discharge end and said roller assemblies being positioned so as to be pivotable into and away from engagement with flexible fill tube.

26. The peristaltic action pump as set forth in claim 25 wherein said flexible fill tube is covered by a flexible, non-elastic sheath member and said roller assemblies engage said sheath member.

* * * * *